United States Patent [19]

Anderson

[11] Patent Number: 5,058,741

[45] Date of Patent: Oct. 22, 1991

[54] CARTON CONSTRUCTION FOR FLEXIBLE DUCT

[75] Inventor: Charles B. Anderson, Jacksonville, Tex.

[73] Assignee: Atco Rubber Products, Inc., Fort Wayne, Tex.

[21] Appl. No.: 580,175

[22] Filed: Sep. 10, 1990

[51] Int. Cl.[5] ..... B65D 85/14

[52] U.S. Cl. ..... 206/321; 206/446; 229/155

[58] Field of Search ..... 206/303, 321, 446, 621, 206/806; 229/127, 128, 130, 132, 135, 136, 143, 155, 156

[56] References Cited

U.S. PATENT DOCUMENTS

| | | | |
|---|---|---|---|
| 2,015,653 | 10/1935 | Andrews . | |
| 2,444,895 | 7/1948 | Ringler | 229/132 |
| 2,946,496 | 7/1960 | Stagmeier . | |
| 3,526,352 | 9/1970 | Swett | 229/128 |
| 3,768,642 | 10/1973 | Hansen et al. . | |
| 3,851,815 | 12/1974 | Desmond et al. | 229/132 |
| 3,891,137 | 6/1975 | Ellison et al. . | |
| 4,200,192 | 4/1980 | Klomp | 206/418 |
| 4,323,188 | 4/1982 | Dickerson . | |
| 4,712,726 | 12/1987 | Fonas | 229/155 |
| 4,722,472 | 2/1988 | Bruno | 229/128 |
| 4,749,083 | 6/1988 | Growney | 206/418 |
| 4,771,884 | 9/1988 | Lamborn et al. | 206/321 |
| 4,773,538 | 9/1988 | Crawford | 206/289 |
| 4,903,431 | 2/1990 | Stoll | 229/155 |
| 4,921,105 | 5/1990 | Culbreth | 206/626 |

FOREIGN PATENT DOCUMENTS

| | | | |
|---|---|---|---|
| 3834083 | 9/1989 | Fed. Rep. of Germany | 229/155 |
| 1150466 | 1/1958 | France | 206/418 |
| 0084992 | 2/1955 | Norway | 206/418 |
| 0569880 | 6/1945 | United Kingdom | 206/418 |
| 1096673 | 12/1967 | United Kingdom | 229/155 |

*Primary Examiner*—Jimmy G. Foster

*Attorney, Agent, or Firm*—Price, Heneveld, Cooper, DeWitt and Litton

[57] ABSTRACT

A carton containing a compressed flexible duct for selected removal of portions of the duct, the carton having a first pair of end flaps and a second pair of end flaps for closing the top end of the carton. The flaps of the first pair each have a length more than one-half the length of the top end to fold segmentally into diagonal extensions into the carton where the distal edges of the first pair can abut each other. The second pair of flaps each has a pair of diagonal creases from the end edges to the distal edge to allow folding of the flap ends to form stops for the first pair of flaps to retain the compressed duct in the carton.

8 Claims, 1 Drawing Sheet

CARTON CONSTRUCTION FOR FLEXIBLE DUCT

BACKGROUND OF THE INVENTION

This invention .relates to a special carton cooperative with compressed flexible duct to enable retention of the compressed duct and dispensing of controlled lengths of the duct from the carton.

Flexible convoluted duct has the capacity to be extended or compressed to various lengths. Such duct typically is constructed of a helical support member as of metal or plastic, and an enclosure jacket which normally surrounds and/or embeds the helical support. When the duct is axially compressed, the helical support has inherent resilient bias tending to return the duct back to its original length. Such duct is typically shipped in compressed condition in a carton. Opening of the carton can result in the compressed duct springing forth not unlike a jack-in-the-box without attachment to the box.

One technique for controlling extension of the duct from the carton is that set forth in U.S. Pat. No. 4,771,884, i.e., providing a restricted opening in the end of the carton, smaller than the duct diameter, to require the duct to be physically pulled through this smaller opening while successive portions of the duct are transversely constricted. Applying these tensile and deformation stresses to the duct is not always desirable.

Another construction for retaining the duct in the carton and allowing controlled lengths to be withdrawn is set forth in pending U.S. application Ser. No. 493,939, filed Mar. 15, 1990, and entitled Flexible Duct and Carton. This provides a breakout panel forming an opening in a side panel larger than the duct diameter, by enabling a portion of this panel to be pulled with a tucked end flap, separated along parallel side edges, and folded down around a crease spaced from the end of the carton.

U.S. Pat. No. 4,921,105 employs a side opening which folds about the card panel.

SUMMARY OF THE INVENTION

An object of this invention is to provide a novel, relatively inexpensive dispensing carton and flexible duct arrangement capable of controllably dispensing the duct without the necessity of passage of the duct through a restricted end opening, or through a side opening. Special cooperative end flaps can open to enable a portion of the compressed duct to be readily removed, and then interengaged to cause the remainder to be retained in the carton.

The novel container has a first pair of opposite, parallel side walls of a width about the diameter of the duct, a second pair of opposite, parallel side walls, either the same width or a multiple of the width of the first pair, and flaps on the side walls forming carton end walls.

The flaps are composed of a first pair of opposite flaps having creased junctures with the first pair of side walls, and a second pair of opposite flaps having creased junctures with the second pair of side walls. These flaps are foldable about these creased junctures. The length of each of the first pair of flaps, i.e., from the creased juncture to the distal edge, is greater than one-half the length of the carton top, such length being measured in the dimension parallel to the dimension in which the flap folds to its closed position. The flaps of the first pair thus overlap each other when folded over the top end of the carton. When the carton is new, it contains the compressed duct therein by the overlapped flaps connected to each other as by adhesive.

When a controlled amount of the compressed duct is to be dispensed, the flaps are pulled apart and opened, allowing a desired amount of duct to be pulled out and cut off, with the remainder being tucked back into the carton. The overlappable flaps are then sequentially folded one at a time into the carton to protrude inwardly at an acute angle so that their distal ends abut each other, to prevent either one from folding outwardly of the carton. Preferably, the second pair of flaps each has a pair of diagonal creases between the end edges of the flap and the distal edge thereof, so that the triangular portions of the flaps can be bent over to form stops at the ends of the first pair of inwardly protruding flaps. The compressed duct is held in place in the carton by the cooperative flaps.

These and other objects, advantages and features of the invention will become apparent upon review of the following detailed specification in conjunction with the drawings.

DESCRIPTION OF THE PREFERRED EMBODIMENT

Figure 1:
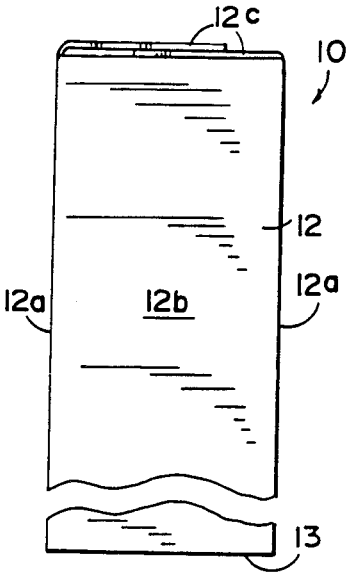
FIG. 1 is a side elevational view of the closed carton as a new carton containing the compressed duct therein.

Referring now specifically to the drawings, the combination 10 depicted includes carton 12 and flexible compressible duct 14 therein.

The duct 14 is composed in typical fashion of a helical support member having inherent resilient bias, and made of metal or resilient plastic in a helical configuration. Combined with this helical support member is a jacket as of plastic, e.g., polyvinylchloride or the like, typically surrounding and sometimes embedding the support member. Because of the inherent resilience and flexibility of the helical support member, the duct can be extended or compressed to various lengths, having an inherent bias to return to its original at-rest length. The wall portions of the jacket between the respective turns of the helical support member are highly flexible so as to fold upon each other in accordion fashion when the structure is compressed. Such a flexible duct can also be flexed laterally from the axial orientation to conform to the installations in which the duct is to be placed. These factors of axial compressibility and configuration arrangements are also advantageous when handling and shipping the duct. That is, the duct can be placed in compressed condition inside the carton to consume less space and enable ease of handling. It is sometimes placed in a generally U-shaped configuration in a carton, and sometimes simply axially oriented. The U-shaped arrangement can also be a series of U-shapes adjacent each other.

The carton 12 comprises a first pair of opposite, parallel, spaced side walls 12*a* shown here to be larger, and another pair of smaller, opposite, parallel, spaced side walls 12*b* which are normal to the first pair of side walls. These side walls are interconnected to form the box. This interconnection can be achieved from a blank by folding the carton along preformed, parallel crease marks that form the corners, overlapping or abutting the final free edges, and securing the free edges together with tape, adhesive or the like. The carton bottom 13 is closed off as by interconnected flaps.

Each of the four side walls has an upper end flap. More specifically, side walls 12*a* have like upper end flaps 12*c*, whereby these flaps can be folded 90° toward each other to collectively form an end wall. The length of these two flaps from their folding crease to their distal edge is greater than one-half the dimension across the top. Hence, these flaps overlap each other when folded to closed position. The other side walls 12*b* have like end flaps 12*d*. The larger flaps 12*c* are preferably folded over the top of the smaller flaps 12*d* after the latter are folded toward each other. Initially, flaps 12*c* of the wider side walls are then preferably taped together with removable tape, or adhered together with a breakaway adhesive, to maintain the end walls in closed condition to contain the compressed duct during shipping and storage.

The second pair of flaps, which have a creased line juncture with the second pair of side walls, have special diagonal crease lines 12*e*, two on each flap. Each diagonal crease line extends between an end edge of the flap and the distal edge of the flap, to define a pair of triangles on the ends of each of the second flaps on the upper end of the carton. These triangular portions of these flaps can then fold about creases 12*e*, inwardly of the carton and toward walls 12*b*, to form stops for abutment by the end edges of flaps 12*c*.

The breadth of the carton, and thus the width of smaller side walls 12*b*, is approximately that of the diameter of the duct or slightly greater. When the duct is shipped in a single U configuration, the width of the carton and thus the width of the larger side walls 12*a* is slightly greater than twice the diameter of the duct. When a single U is formed, both free ends of the duct abut the same end wall. When the duct is in simple axial orientation, the opposite ends of the duct will abut opposite ends of the carton. Such a duct is considerably compressed axially in this packed condition such that, by closure of the flaps to form the end walls, there is resilient bias against the end walls by the duct.

Therefore, when flaps 12*d* have their triangular end portions so folded, and the flaps 12*d* are tucked inwardly of the carton, and the first flaps 12*c* are sequentially folded inwardly into the carton, flaps 12*c* will be retained in this carton by abutment of their distal edges against each other and abutment of their ends against the triangular stops to block the compressed duct from springing out of the carton.

In use, carton 12 is converted from its planar blank condition by folding it along the crease lines and securing the opposite free edges together. The flaps on one end of the carton are closed and secured to form the closed lower end wall 13. The duct is then compressed and forced into the carton, after which the flaps on the opposite end of the carton are folded over each other and secured, e.g., glued or taped, to form a closed upper end wall. The unit is then ready for shipment and/or storage as necessary.

Figure 2:
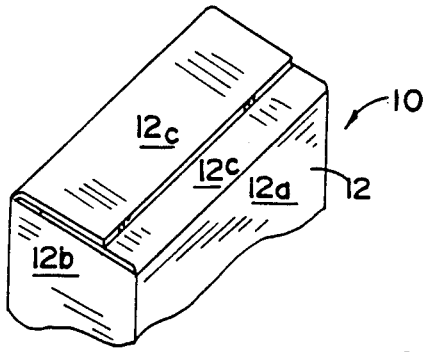
FIG. 2 is a perspective fragmentary view of the carton in FIG. 1.
Figure 3:
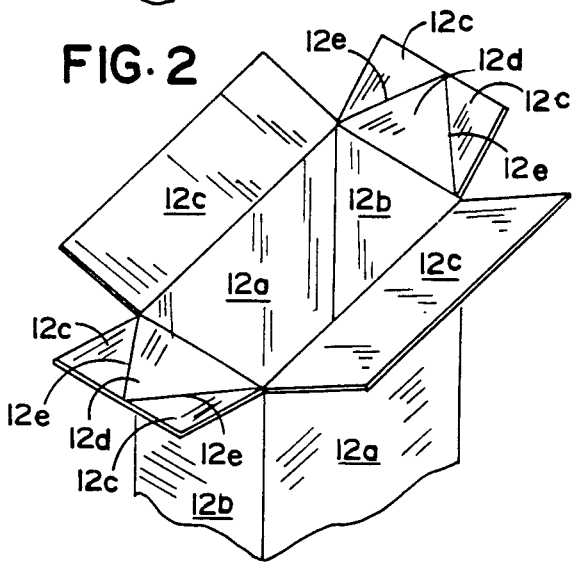
FIG. 3 is a fragmentary perspective view showing the carton with its flaps open.
Figure 4:
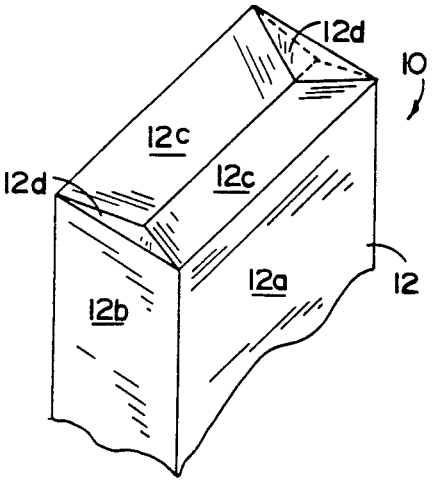
FIG. 4 is a fragmentary perspective view of the carton top with the flaps reclosed and protruding inwardly of the carton for retaining the compressed duct therein.
Figure 5:
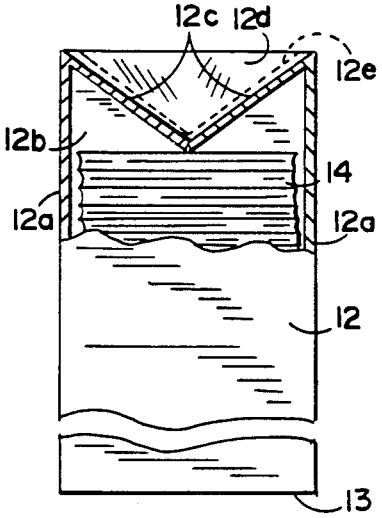
FIG. 5 is a fragmentary, sectional, elevational view of the carton and duct in FIG. 4.

When it is desired to remove a predetermined length of flexible duct from the carton, the overlapped flaps 12*c* and 12*d* (FIGS. 1 and 2) are detached from each other to open the end of the carton (FIG. 3) and allow a selected length of compressed duct to be pulled free. This selected amount is then cut off the duct, and the remaining portion can be tucked back into the carton. The triangular portions of the second pair of flaps 12*d* are then folded about diagonal creases 12*e*, and these flaps are folded inwardly of the carton. Next, flaps 12*c* are sequentially folded inwardly past and beneath the diagonal edges of the second pair of flaps and are caused to spring back to the diagonal condition in FIG. 5 by the bias of the compressed duct, causing the inwardly protruding pair 12*c* to engage each other along their distal edges and engage the folded diagonal stop portions of flaps 12*d*. These flaps remain in this condition under the bias of the compressed duct thereagainst.

When more duct is to be removed, the workman merely flattens the second flaps against their adjacent side walls, pulls out the first flaps sequentially, and temporarily releases the duct.

It is conceivable that certain variations on this construction of the preferred embodiment may be made within the concept presented. The invention is intended to be limited only by the scope of the appended claims and the reasonably equivalent structures to those defined therein.

The embodiments of the invention in which exclusive property is claimed are defined as follows.

1. A combination carton and compressed flexible duct comprising:

four side walls including a first pair of opposite parallel side walls and a second pair of opposite parallel side walls normal to and joined to said first pair, said walls together defining top and bottom openings;

a bottom end to cover said bottom opening and a top end to cover said top opening;

said top end having a first pair of opposite flaps joined to said first pair of side walls about creased junctures and foldable about said creased junctures toward each other, and a second pair of opposite flaps joined to said second pair of said walls about creased junctures;

said flaps each having a distal edge opposite said creased juncture;

said first pair of flaps each having a length from its said creased juncture to its said opposite distal edge greater than one-half the length of said top opening, and being foldable sequentially through said top open to enable said distal edges to be in inwardly projecting abutment with said other;

said second flaps having angular crease means for forming stops on said second flaps for said inwardly projecting first flaps to thereby retain said first flaps in abutment therewith for restraining said first pair of flaps from opening; and a compressed flexible duct in said carton, applying a bias on said flaps toward said top end.

2. The carton in claim 1 wherein said angular crease means comprises a pair of angular creases on each flap a said second pair, whereby portions of said second pair of flaps are foldable about said creases, forming a pair of stops on each flap.

3. A carton comprising:

four side walls including a first pair of opposite parallel side walls and a second pair of opposite parallel side walls normal to and joined to said first pair, said walls together defining top and bottom openings;

a bottom end to cover said bottom opening and a top end to cover said top opening;

said top end having a first pair of opposite flaps joined to said first pair of side walls about creased junctures and folded about said creased junctures toward each other, and a second pair of opposite flaps joined to said second pair of side walls about creased junctures;

said flaps each having a distal edge opposite said creased juncture;

said first pair of flaps each having a length from its said creased juncture to its said opposite distal edge greater than one-half the length of said top opening, and being folded through said top opening to cause said distal edges to be in inwardly projecting abutment with each other;

said second flaps having angular crease means for forming stops on said second flaps for said inwardly projecting first flaps to thereby retain said first flaps in abutment therewith for restraining said first pair of flaps from opening;

said angular crease means comprising a pair of angular creases on each flap of said second pair, portions of said second pair of flaps being folded about said creases, forming a pair of stops on each flap;

each flap of said second pair having opposite end edges parallel to said first side walls, and a distal edge parallel to said second side walls;

said angular crease means comprising two creases extending from said opposite end edges to said distal edge to define a pair of triangles folded along said angular creases and abutted by said first pair of inwardly projecting flaps.

4. A combination carton and compressed flexible duct comprising:

four side walls including a first pair of opposite parallel side walls and a second pair of opposite parallel side walls normal to and joined to said first pair, said walls together defining top and bottom openings;

a bottom end to cover said bottom opening and a top end to cover said top opening;

said top end having a first pair of opposite flaps foldable about creased junctures with said first pair of side walls;

said first pair of flaps each having a length from said creased juncture to the opposite distal edge of the flap greater than one-half the length of said top opening, and being foldable sequentially through said top opening into inwardly projecting abutment with each other, inhibiting outward movement of said first flaps for keeping said top end closed; and a compressed flexible duct in said carton applying a bias on said flaps toward said top end.

5. The carton in claim 4 wherein said top end includes a second pair of opposite flaps foldable about creased junctures with said second pair of side walls.

6. The carbon in claim 5 wherein each flap of said second pair of flaps includes portions forming stops for engagement by said first pair of flaps.

7. The carton in claim 6 wherein each second pair as diagonal creases for folding portions of said second pair to form said stops.

8. A carton comprising:

four side walls including a first pair of opposite parallel side walls and a second pair of opposite parallel side walls normal to and joined to said first pair, said walls together defining top and bottom openings;

a bottom end to cover said bottom opening and a top end to cover said top opening;

said top end having a first pair of opposite flaps folded about creased junctures with said first pair of side walls;

said first pair of flaps each having a length from said creased juncture to the opposite distal edge of the flap greater than one-half the length of said top opening, and being folded through said top opening into inwardly projecting abutment with each other, inhibiting outward movement of said first flaps for keeping said top end closed;

said top end including a second pair of opposite flaps folded about creased junctures with said second pair of side walls;

each flap of said second pair of flaps including portions forming stops for engagement by said first pair of flaps;

each second pair having diagonal creases folded to form said stops;

each flap of said second pair having a pair of opposite end edges and a distal edge which is opposite and parallel to said creased juncture, and each flap of said second pair having two said diagonal creases which extend between said end edges and said distal edge, whereby said first pair of flaps abut said diagonal crease stops and each other to keep said top closed.

* * * * *

UNITED STATES PATENT AND TRADEMARK OFFICE

CERTIFICATE OF CORRECTION

PATENT NO. : 5,058,741

DATED : October 22, 1991

INVENTOR(S) : Charles B. Anderson

It is certified that error appears in the above-identified patent and that said Letters Patent is hereby corrected as shown below:

Column 4, line 44;
"said walls" should be -- side walls --;

Column 4, line 63;
"a said" should be -- of said --.

Signed and Sealed this

Fourth Day of May, 1993

*Attest:*

Michael K. Kirk

MICHAEL K. KIRK

*Attesting Officer*

*Acting Commissioner of Patents and Trademarks*